US008264168B2

(12) United States Patent
Feri et al.

(10) Patent No.: US 8,264,168 B2
(45) Date of Patent: Sep. 11, 2012

(54) METHOD AND A SYSTEM FOR CONTROLLING A LIGHTING SYSTEM

(75) Inventors: Lorenzo Feri, Eindhoven (NL); Dragan Sekulovski, Eindhoven (NL); Sel Brian Colak, Eindhoven (NL); Johan Paul Marie Gerard Linnartz, Eindhoven (NL); Paulus Henricus Antonius Damink, Eindhoven (NL); Jorge Guajardo Merchan, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 411 days.

(21) Appl. No.: 12/599,311

(22) PCT Filed: May 5, 2008

(86) PCT No.: PCT/IB2008/051735

§ 371 (c)(1), (2), (4) Date: Nov. 9, 2009

(87) PCT Pub. No.: WO2008/139360

PCT Pub. Date: Nov. 20, 2008

(65) Prior Publication Data

US 2010/0301776 A1 Dec. 2, 2010

(30) Foreign Application Priority Data

May 9, 2007 (EP) ..... 07107806

(51) Int. Cl.
*H05B 37/00* (2006.01)

(52) U.S. Cl. ..... 315/294; 315/295; 315/307; 315/308

(58) Field of Classification Search ..... 315/291, 315/292, 307, 308, 294, 295, 312, 316, 317, 315/318, 322

See application file for complete search history.

(56) References Cited

U.S. PATENT DOCUMENTS 5,187,655 A 2/1993 Post et al.

(Continued)

FOREIGN PATENT DOCUMENTS

WO 9805188 A1 2/1998
WO 0046671 A1 8/2000
WO 0213490 A2 2/2002

(Continued)

OTHER PUBLICATIONS

Lutron Lighting Controls: The Park Hyatt Paris-Vendome; 2004, 4 Page Brochure.

*Primary Examiner* — David Hung Vu
(74) *Attorney, Agent, or Firm* — Mark L. Beloborodov

(57) ABSTRACT

A location commissioning method for a lighting system, having several lighting arrangements, includes selecting an illuminated position, assigning the position a position id, measuring light at the position, deriving light data associated with each lighting arrangement from the measured light, associating the light data with the position id, determining light transfer data from the light data and current drive data for the lighting arrangements, and storing in a light effect setting array for the position id. A light effect setting method includes requesting a selected light effect at a selected position, receiving a position id and a target light effect setting associated with the position, deriving the associated initial light effect setting array, for example by retrieving a stored one, determining the drive data for obtaining the target light effect setting, via the light transfer data in the array.

11 Claims, 5 Drawing Sheets

U.S. PATENT DOCUMENTS

| | | | | |
|---|---|---|---|---|
| 6,016,038 | A | 1/2000 | Mueller et al. | |
| 7,190,126 | B1 | 3/2007 | Paton | |
| 7,205,729 | B2 * | 4/2007 | Thielemans et al. | 315/292 |
| 7,557,524 | B2 * | 7/2009 | Chevalier et al. | 315/318 |
| 2002/0014972 | A1 | 2/2002 | Danielson et al. | |
| 2002/0180973 | A1 | 12/2002 | MacKinnon et al. | |
| 2003/0020595 | A1 | 1/2003 | Wacyk | |
| 2005/0111231 | A1 | 5/2005 | Crodian et al. | |
| 2005/0273237 | A1 | 12/2005 | Huang et al. | |

FOREIGN PATENT DOCUMENTS

| | | | |
|---|---|---|---|
| WO | 03679374 | A2 | 8/2003 |
| WO | 2004023224 | A2 | 3/2004 |
| WO | 2004057927 | A1 | 7/2004 |
| WO | 2004100613 | A1 | 11/2004 |
| WO | 2005096677 | A1 | 10/2005 |
| WO | 2006111927 | A1 | 10/2006 |
| WO | 2006111930 | A2 | 10/2006 |

* cited by examiner

METHOD AND A SYSTEM FOR CONTROLLING A LIGHTING SYSTEM

FIELD OF THE INVENTION

The present invention relates to a method and a system for controlling a lighting system, which includes several lighting arrangements, and more particularly to a location commissioning method and an associated setting method, and to corresponding systems.

BACKGROUND OF THE INVENTION

The role of electronic control in illumination applications is rapidly growing. The number of lighting arrangements in an environment is increasing, especially with the introduction of SSL (Solid State Lighting) LED lighting, and can involve hundreds of lighting arrangements in the same room. This opens up the possibility for creative light settings, but also the demand for user friendly ways of designing and controlling these complex light effects. As one can imagine, the control of hundreds of lighting arrangements to generate even the simplest light distribution will become a non trivial issue.

In an initial phase standard commissioning, i.e. assigning the relationship between each lighting arrangement and a control unit, in an environment with hundreds of lighting arrangements may become cumbersome. Manual commissioning done by a worker who connects cables from the lighting arrangements to a switch is no longer an option.

Furthermore, there is a need for commissioning the relationship between the contribution of each lighting arrangement and the light effect obtained in certain target locations in the room, which commissioning hereinafter is referred to as location commissioning, which is also called Luxissioning™ (from lux and commissioning).

In a prior art system as described in the international application WO 2006/111927, published on 26 Oct. 2006, a feedback system for controlling the light output of a lighting system comprising a multitude of lighting arrangements is provided. The lighting arrangements in the system are modulated with an identification code and are controlled by a main control device. Furthermore the system includes a user control device. By measuring the light at different positions, using the user control device, and by deriving the contributions from each lighting arrangements based on their individual identification codes, and subsequently by transferring light data to the main control, the system creates a feed-back of the produced light data to the main control device. The main control device then adjusts the drive data to the lighting arrangements based on the feed-back light data and additional user input. With the aid of a computer program the main control determines the influence or effect that a specific change of the main control drive data has on the derived light data at the measurement location. Consequently the main control device learns, ad-hoc, how to obtain a desired light effect at a certain location. The system is capable of tracking the position of the user control device and moving an initial light effect to follow the user control.

It is desirable to provide an alternative solution that can location commission the lighting arrangements of multiple lighting arrangements in a room and allows the system to use the location commissioning information for controlling light effect settings in the room in a more straight forward manner.

SUMMARY OF THE INVENTION

It is an object of the present invention to provide a location commissioning method (and an associated setting method) of a lighting system, which includes several lighting arrangements, that provides a location commissioning which facilitates subsequent light effect settings.

According to a first aspect of the present invention there is provided a location commissioning method for a lighting system, which includes several lighting arrangements. The method including the steps of:

in at least one illuminated position:
assigning the position a position id;
measuring the light;
deriving light data associated with each one of the lighting arrangements from the measured light;
associating the light data with the position id;
determining light transfer data on the basis of the light data and current drive data for the lighting arrangements; and
storing a light effect setting array, including the light transfer data, for the position.

The method provides a beneficial way of location commissioning a room by mapping the transfer data from several lighting arrangements associated to at least one position in the room and storing the transfer data for later use. The location commissioning gives information about how each individual lighting arrangement contributes to the illumination in a certain position in the room. Furthermore, the location commissioning provides transfer data that is useful later on for control/setting purposes.

The determination of the contribution of each lighting arrangement in a certain location is of central importance in order to produce a certain light effect in a specific location. In complex environments, which may be populated with many objects, some lighting arrangements are blocked and give a partial or no contribution in a certain area. Unexpected effects like blocking, shadowing, and reflection are easily taken into account by the present invention. By location commissioning the room cumbersome computations taking into account the layout and physical properties of the environment are avoided.

It should be noted that in assigning the position a position id includes, for example, receiving a position id from a user/operator, as well as using a default, predetermined or automatically generated position id.

According to another embodiment of the present invention, the light effect setting array further includes the light data. The light data can be simply the detected light power (lux), but can instead or additionally include information about color contents, light intensity and so forth, which gives details about each lighting arrangement and its contribution to the illumination in a certain position. Since the lighting arrangements are individually mapped, differences in any characteristic of the lighting arrangements or physical environment of the lighting arrangements are automatically mapped and taken into account when using the commissioned light effect setting array for controlling the lighting arrangements.

According to a further embodiment of the present invention, the light effect setting array further includes the current drive data. Since the current drive data for different light effect settings are known, optimizing the lighting with respect to for instance applied electrical power is possible.

According to yet another embodiment of the present invention, the light transfer data includes attenuation data. The attenuation data of a lighting arrangement for a certain position describes how the transmitted light of the lighting arrangement is attenuated when reaching the position. Hence a lighting arrangement placed far away from the position would have a larger attenuation than a lighting arrangement placed close by the position, provided that the initial intensity of light at each lighting arrangement is the same. The mapping of all lighting arrangement for a position hence gives information about how to drive the individual lighting arrangements to obtain a target light effect setting.

According to yet a further embodiment of the present invention, the light data includes measured light power (lux), and the current drive data includes transmitted light power (candela), which is favorable.

According to even a further embodiment of the present invention, the step of storing a light effect setting array includes storing the light effect setting array at a main control device, which is arranged to control the lighting arrangements. When a large amount of data is collected it is favorable to store the light effect setting arrays in a main control device, having a large storage and processing capacity for handling the data. Since the main control device is arranged to control the lighting arrangements, the access to the stored light effect setting arrays is faster when stored in the unit itself.

According to even another embodiment of the present invention, the step of storing a light effect setting array includes storing the light effect setting array at a user control device, which is advantageous when location commissioning only a few positions in a room and/or when a portable control device is preferred.

According to yet even another embodiment of the present invention, powering up of the lighting arrangements includes the step of—for each position—powering up only one lighting arrangement at a time, whereby the steps of measuring the light, deriving light data and associating the light data with said position id are performed for each one of said lighting arrangements. This embodiment is preferably used when the number of lighting arrangements is not too large or when only a few positions need to be location commissioned. With this embodiment the identification of light sources in the lighting arrangements can hence be solved manually.

According to yet even a further embodiment of the present invention, each lighting arrangement is provided with an identification code, and the step of deriving light data further includes identifying light data from each one of the lighting arrangements on the basis of the identification codes. Hence the identification of each lighting arrangement is made automatically. The user can just switch on all lighting arrangements and hold the user control unit in the position to be location commissioned. The operation for location commissioning each position using this embodiment would not take more than a few seconds. Using identification codes also decreases the risk of ascribing interfering ambient background light to the contribution of a certain lighting arrangement.

According to one further embodiment of the present invention, the method further includes the step of optimizing the lighting arrangement's outputs relative to at least one parameter in the stored light effect setting array, like for instance the total driving power.

According to yet one further embodiment of the present invention, the lighting arrangements are powered to obtain a required light effect in a certain location. An individual light effect setting array for the required light effect is stored for future use.

When powering the lighting arrangements to have a certain light effect, and location commissioning this light effect, the light effect is stored and preferably given an intuitive name, as position id, in order to have a convenient way of using the location commissioned data in a control mode. Hence, a professional light effect designer can create a requested light effect and location commission it, so that later on an unskilled user may use that location commissioned data to obtain a professional light setting.

According to a second aspect of the present invention, there is provided a light effect setting user device for setting light effects produced by a plurality of lighting arrangements in a certain location utilizing light effect setting data produced according to the first aspect of the present invention. The device includes means for receiving said light effect setting data, means for determining drive data according to the chosen light effect setting, means for transferring the drive data to a driving unit of the lighting arrangements, and a user interface which includes means for displaying light effect setting data and a selection tool for choosing a light effect setting.

Since the user device has access to commissioned locations, and hence light effect setting data in which a certain light effect is given an intuitive name, the user can simply select a stored light effect for certain positions and hence in an easy and elegant way control the lighting effects in a room.

According to another embodiment of the user device, the user device further includes means for storing said light effect setting data.

According to a further embodiment of the user device, the selection tool allows for changing at least one light feature of chromaticity, intensity, hue, saturation and spot size.

According to yet another embodiment of the user device, the selection tool allows for selecting a predetermined light effect setting derived from the light effect setting data.

According to yet a further embodiment of the user device, the device is displayed in one of an interactive screen on a wall or on a remote control.

According to a third aspect of the present invention, there is provided a light effect setting method for controlling lighting arrangements of a lighting system, which includes several lighting arrangements, according to at least one request R which requests a selected light effect at a selected position. The method includes, for each request, the steps of:

- receiving request data including a position id and a target light effect setting associated with the position corresponding to the id;
- obtaining an associated initial light effect setting array including light transfer data of the lighting arrangements for the position;
- determining, by means of the light transfer data, required drive data for the lighting arrangements, to obtain the target light effect setting;
- adjusting currently applied drive data of the lighting arrangements in accordance with the required drive data.

Hence, a user can easily and elegantly control hundreds of lighting arrangements by selecting one or more positions and a desired light effect in each position. In accordance with the method of the present invention, the required light data is then determined automatically, letting the unskilled user act as a professional light setting designer without actually knowing how to control the individual lighting arrangements.

According to another embodiment of the light effect setting method, the light transfer data includes attenuation data. The step of determining required drive data includes the steps of:

- deriving a vector of attenuation parameters for lighting arrangements 1 to n for position j from the initial light effect setting array according to: $a_j=[a_{1j}, a_{2j}, \ldots, a_{nj}]$
- deriving a required radiant power $U_j$, for light in position j from the target light effect setting;
- calculating an transmitted radiant power $T_{i,j}$ for each lighting arrangement i based on $U_j$ and $a_j$ for light in position j.

The calculations for a desired transmitted radiant power hence advantageously utilize attenuation parameters of each lighting arrangement for a position from previously location commissioned light transfer data to determine the required drive data necessary to obtain the target light setting. Hence, irrespective of the light effect required, the drive data for obtaining the target light setting can be determined since the attenuation between each lighting arrangement and the requested position is known.

According to a further embodiment of the light effect setting method, the lighting arrangements emit different primary colors, where the number of primary colors is p, and where the number of lighting arrangements of each primary color is $l_k$, wherein said desired radiant power $U_j$ for light in position j equals the sum of the radiant powers of the p primary colors according to:

$$U_j = U_{1,j} + U_{2,j} + \ldots + U_{p,j} = \sum_{k=1}^{p} U_{k,j},$$

wherein the required radiant powers $U_{1,j}, U_{2,j}, \ldots, U_{p,j}$ for each primary color are determined by performing the steps of:

mapping the color point of said target light effect in a p-dimensional primary color space; and extracting from the color space the required amount of radiant power $U_{1,j}, U_{2,j}, \ldots, U_{p,j}$ for each primary color;

and wherein the step of calculating the transmitted radiant power is done for each primary color, where $T_{i,j} = T_{i^{(k)},j}$ for $i^{(k)} \in \{1, \ldots, l_k\}$ and $k \in \{1, \ldots, p\}$. Thereby it is possible to not only choose different light intensities but also different colors for different light settings.

According to yet another embodiment of the light effect setting method, the step of calculating a transmitted radiant power $T_{i^{(k)},j}$ for each lighting arrangement $i^{(k)}$ in each primary color k for a position j is done according to:

$$T_{i^{(k)},j} = \frac{1}{a_{i^{(k)},j}} U_{k,j} \frac{a_{i^{(k)},j}}{\sum_{m=1}^{l_k} a_{m,j}} \text{ for } i^{(k)} \in \{1, \ldots, l_k\} \text{ and } k \in \{1, \ldots, p\},$$

wherein $l_k$ is the total number of lighting arrangements in primary color k, $U_{k,j}$ is the required radiant power for primary color k at a position j, and $a_{i^{(k)},j}$ is the power attenuation from lighting arrangement $i^{(k)}$ to location j.

The attenuation parameters are effectively used to weight the required transmitted radiant power for each lighting arrangement.

According to yet a further embodiment of the light effect setting method, the request data further includes a size $\gamma_j$ of a spot of light for the lighting arrangements in the position j, which results in more precise calculations of how to obtain the target light effect setting.

According to even a further embodiment of the light effect setting method, the step of calculating a transmitted radiant power $T_{i^{(k)},j}$ of each lighting arrangement $i^{(k)}$ in each primary color k for a position j is done according to:

$$T_{i^{(k)},j} = \frac{1}{a_{i^{(k)},j}} U_{k,j} \frac{a_{i^{(k)},j}^{\gamma_j}}{\sum_{m=1}^{l_k} a_{m,j}^{\gamma}} \text{ for } i^{(k)} \in \{1, \ldots, l_k\} \text{ and } k \in \{1, \ldots, p\}$$

wherein $l_k$ is the total number of lighting arrangements in primary color k, $U_{k,j}$ is the required radiant power for primary color k at a position j, $a_{i^{(k)},j}$ is the power attenuation from lighting arrangement $i^{(k)}$ to location j, and $\gamma_j \in [1, \text{inf})$, and wherein for $\gamma_j = 1$, all the lighting arrangements contribute equally to the target light effect, and when $y_j$ tends to infinity, only the closest lighting arrangement is powered.

By controlling the parameter for the spot size, the user can create more complex light effect settings.

According to even another embodiment of the light effect setting method, the method further includes the steps of for a number of user request R>1: calculating a resulting transmitted power $\overline{T_{i^{(k)}}}$, as a weighted average of the transmitted radiant power $T_{i^{(k)},j}$ of lighting arrangement $i^{(k)}$ of primary color k to the position j, by means of least square fitting.

According to yet even another embodiment of the light effect setting method, the resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j}}{\sum_{m=1}^{R} a_{i^{(k)},m}} \text{ for } i^{(k)} \in \{1, \ldots, l_k\} \text{ and } k \in \{1, \ldots, p\}$$

wherein $l_k$ is the total number of lighting arrangements for primary color k, $T_{i^{(k)},j}$ is the transmitted radiant power of lighting arrangement $i^{(k)}$ of primary color k to the position j, $a_{i^{(k)},j}$ is the power attenuation from lighting arrangement $i^{(k)}$ to location j and $R \in \{1, \ldots, \text{inf}\}$ is the total number of user requests.

According to yet even a further embodiment of the light effect setting method, each one of the light effects is provided with a particular priority ρ for a position j, whereby a light effect with a higher priority will have a larger contribution to the achieved target settings than a light effect with a lower priority. Since the user is allowed to make more than one request, each at different positions in a room, a number of conflicting requirements for the individual lighting arrangement might occur. By providing a light effect with a higher priority setting this problem is addressed, and according to the method of the present invention, the contribution from each lighting arrangement to different light effect requests are weighted according to the priority setting of each light effect.

According to one further embodiment of the light effect setting method, the resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j}^{\rho_j}}{\sum_{m=1}^{R} a_{i^{(k)},m}^{\rho_j}} \text{ for } i^{(k)} \in \{1, \ldots, l_k\} \text{ and } k \in \{1, \ldots, p\}$$

wherein $l_k$ is the total number of lighting arrangements for primary color k, $T_{i^{(k)},j}$ is the transmitted radiant power of lighting arrangement $i^{(k)}$ of primary color k to the position j, $a_{i^{(k)},j}$ is the power attenuation from lighting arrangement $i^{(k)}$ to location j, $R \in \{1, \ldots, \text{inf}\}$ is the total number of user requests, and $\beta_i \in [1, \text{inf})$, indicates the priority of a light effect in the position j.

According to yet one further embodiment of the light effect setting method, a global priority array, $w_q$, is assigned to indicate a global priority setting for each request R.

According to another embodiment of the light effect setting method, the global priority is a function of time $w_q(t)$.

According to a further embodiment of the light effect setting, method a global priority array, $w_{q,j}$, is assigned to indicate a global priority setting for each position j.

According to yet another embodiment of the light effect setting, method the global priority array is a function of time $w_q(t)$.

According to yet a further embodiment of the light effect setting method, the resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j} \cdot z_j}{\sum_{m=1}^{R} a_{i^{(k)},m} \cdot z_m} \quad \text{for } i^{(k)} \in \{1, \ldots, l_k\} \text{ and } k \in \{1, \ldots, p\}$$

wherein $a_{i^{(k)},j}$ is the power attenuation from lighting arrangement $i^{(k)}$ to location j, and $z_j$ is a mapping of said global priorities.

According to even a further embodiment of the light effect setting method, the local and global priorities are considered, wherein the resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j}^{\rho_j} \cdot z_j}{\sum_{m=1}^{R} a_{i^{(k)},m}^{\rho_j} \cdot z_m} \quad \text{for } i^{(k)} \in \{1, \ldots, l_k\} \text{ and } k \in \{1, \ldots, p\}$$

where $\rho_j \in [1, \text{inf})$ indicates said local priority of the request j and $a_{i^{(k)},j}$ is the power attenuation from lighting arrangement $i^{(k)}$ to location j and $z_j$ is a mapping of said global priorities.

According to even another embodiment of the light effect setting method, the global right is associated with a user.

According to yet even another embodiment of the light effect setting method, the method further includes the step of smoothly converging from a starting light effect setting to the target light effect setting. Thus, no abrupt changes of the light setting occurs when the user choose to change the light setting of the room. On the contrary a pleasant switching between the starting light effect setting to the target light effect setting is performed.

According to yet even a further embodiment of the light effect setting method, the step of smoothly converging is done by

- defining the difference in transmitted radiant power for the starting light effect setting to the target light effect setting
- defining intermediate steps of transmitted radiant powers
- changing the light effect setting by the intermediate steps in the drive data until the target light effect setting is obtained.

According to one further embodiment of the light effect setting method as, the intermediate steps have a maximum step size, which is related to human perception.

According to yet one further embodiment of the light effect setting method, the at least one user request R is restricted to a particular user control right that is provided by an access control mechanism. Hence, each authorized user is assigned a personal user right that describes the way the user is allowed to operate the light effect settings in the room.

According to another embodiment of the light effect setting method, the access control mechanism is based on public-key cryptography.

According to a further embodiment of the light effect setting method, the access control mechanism is based on symmetric-key cryptography. The user right setting methods are based on either public-key or symmetric-key cryptography to provide a secure system, which is protected against passive and active attackers from performing unauthorized operations.

According to yet another embodiment of the light effect setting method, the step of obtaining said associated initial light effect setting array further includes the step of performing a location commissioning.

According to yet a further embodiment of the light effect setting method, the associated initial light effect setting array is retrieved from data stored in a previously performed location commissioning.

According to an another aspect of the present invention, there is provided a location commissioning system including several lighting arrangements, which includes means for driving the light output of the lighting arrangements by lighting drive data, a user control device including means for assigning a position id to a current position of the user control device, means for measuring light data from the lighting arrangements, means for transmitting the light data and position id, a main control device including means for receiving light data and position id from the user control device, and means for transmitting drive data to the lighting arrangements. The main control device further includes means for determining light transfer data associated to the position id on basis of the light data and current drive data for the lighting arrangements, and means for storing a light effect setting array, which includes the light transfer data for the position id.

According to another embodiment of the location commissioning system, the light effect setting array further includes the light data.

According to a further embodiment of the location commissioning system, the light effect setting array further includes the current drive data.

According to yet another embodiment of the location commissioning system, the light transfer data includes attenuation data.

According to yet a further embodiment of the location commissioning system, the light data includes measured light power (lux), and the current drive data includes transmitted light power (candela).

According to an another aspect of the present invention, there is provided a light effect control system including several lighting arrangements, means for driving the light output of the lighting arrangements by lighting drive data, a user control device including means for retrieving at least one set of request data, which request data includes a selected target light effect setting at a selected position id, and means for transmitting the at least one set of request data, a main control device including means for receiving request data from the user control device, and means for transmitting drive data to the lighting arrangements. The main control device further includes means for fetching a stored associated initial light effect setting array including light transfer data for the lighting arrangements at the position id, means for determining, by means of the light transfer data, required drive data for the lighting arrangements, for obtaining the target light effect setting, and means for adjusting currently applied drive data of the lighting arrangements in accordance with the required drive data.

According to another embodiment of the light effect control system, the means for obtaining an associated initial light effect setting array are arranged to retrieve said associated initial light effect setting array from a storage medium.

According to a further embodiment of the light effect control system, the means for obtaining an associated initial light effect setting array are further arranged to perform a location commissioning, and thereby obtaining an associated initial light effect setting array.

According to yet another embodiment of the light effect control system, the light transfer data includes attenuation data, and wherein the main control device further includes means for deriving a vector of attenuation parameters for lighting arrangements 1 to n for position j from the initial light effect setting array according to:

$a_j=[a_{1,j},a_{2,j},\ldots,a_{n,j}]$, and deriving a required radiant power $U_j$ for light in position j from the target light effect setting, and calculating a transmitted radiant power $T_{i,j}$ for each lighting arrangement i based on $U_j$ for light in position j.

According to yet a further embodiment of the light effect control system, the calculation of transmitted radiant power $T_{i,j}$ is done by a light effect setting method.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
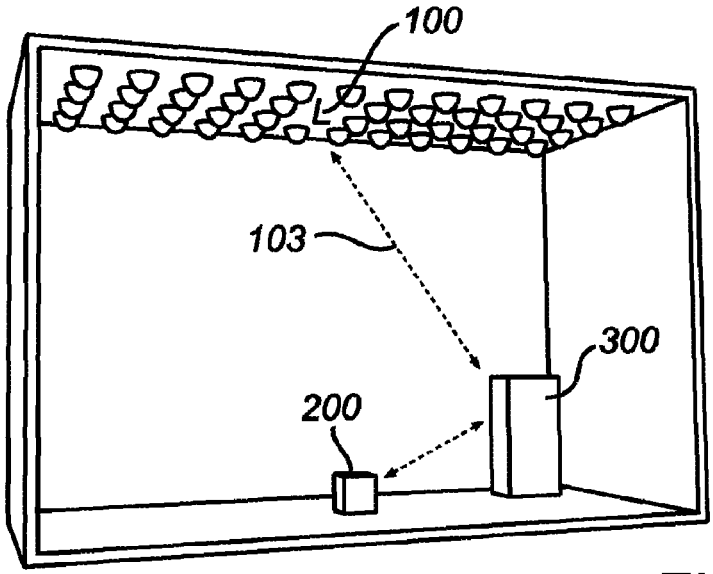
FIG. 1 shows a schematic drawing of a lighting system according to the present invention.

FIG. 1 shows a schematic drawing of an embodiment of a lighting system according to the present invention. The system consists of three main parts, namely lighting arrangements 100, a user control unit 200, and a main control device 300. The lighting arrangements 100 are for instance mounted in the ceiling of a room. They could for example also be mounted on the walls of the room or in furniture or appliances present in the room. The main control device 300 is arranged to control the lighting arrangements 100, and to receive data 203 from the user control unit 200. Furthermore the main control device 300 is arranged to store and process data. The communication between the main parts of the system is preferably based on wireless communication, but can be based on wired communication as well. The lighting system is useful for location commissioning purposes and produces relevant data for subsequent light control, i.e. light effect settings, enabling different light effects in the room at different times as well as in different positions of the room.

Figure 2:
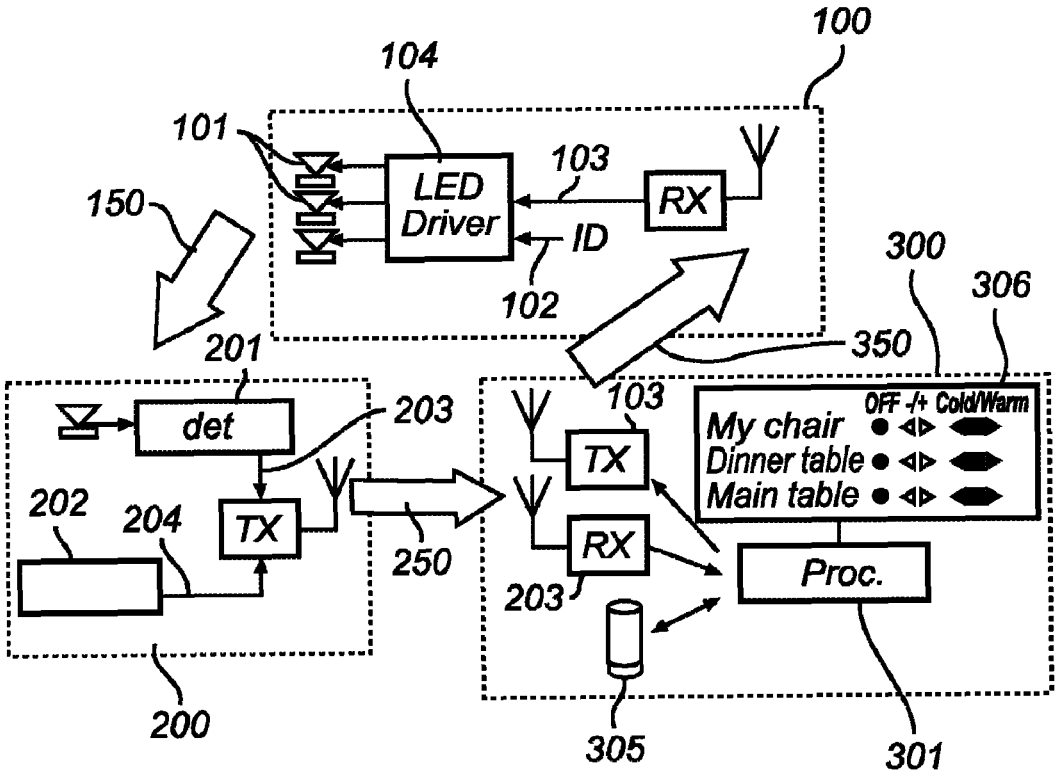
FIG. 2 shows a block diagram of an embodiment of a location commissioning system according to an aspect of the present invention.

Referring now to FIG. 2, according to an embodiment of the location commissioning system (or Luxissioning™ system), i.e. the lighting system when it is used for performing location commissioning operations, the lighting arrangements 100 are arranged to receive drive data 103 from the main control device 300 via a wireless communication link 350 based on ZigBee, which uses the IEEE 802.15.4 standard. IEEE 802.15.4 is a standard for low rate personal area networks (PAN). The standard deals with low data rate but very long battery life (months or even years) and very low complexity.

In FIG. 2 only one lighting arrangement 100 is shown. The lighting arrangements 100 each include a number of light sources 101, preferably white LEDs (Light Emitting Diodes), or colored LEDs, e.g. in sets of primary colors like RGB. However at a minimum, each lighting arrangement has a single light source. Other types of light sources are compatible with the present inventive idea and are included within the scope of the invention. The light sources 101 are provided with driving circuitry 104, which is receiving the drive data 103. The driving of the light sources 101 typically is done by adjusting the applied power level and driving pattern. In an embodiment according to the present invention each individual light arrangement 100 is provided with an individual identification code 102, e.g. by modulating the driving voltage of each lighting arrangement 100 with an individual driving signature according to well-known manners. The user control unit 200, which in this embodiment is implemented in Personal Digital Assistant (PDA) to act as a remote control, is arranged to measure the transmitted light 150 from the lighting arrangements 100 with a detector 201. The output from the detector 201 is referred to as light data 203. Furthermore the user control unit 200 is provided with means for assigning a position id 204, i.e. a user interface 202 like for instance a keypad. Each position id 204 is representative of a particular position in the room. The user control unit 200 is arranged with means for transmitting light data 203 and position id 204 via a transmission link 250 on a Wireless Local Area Network (WLAN).

The main control device 300 receives the light data 203. The main control device is provided with processing means 301, such as a CPU, and means for storing data 305, which is implemented as a data base 305. In the main control device 300 light transfer data is determined based on the light data 203 and the current drive data 103, i.e. the drive data that is currently provided to the lighting arrangements 100. The light transfer data associated to a position id 204 is stored as light effect setting arrays in the data base 305. The main control device 300 performs the processing tasks according to a computer program implementation of a location commissioning method in accordance with the present invention.

Figure 3:
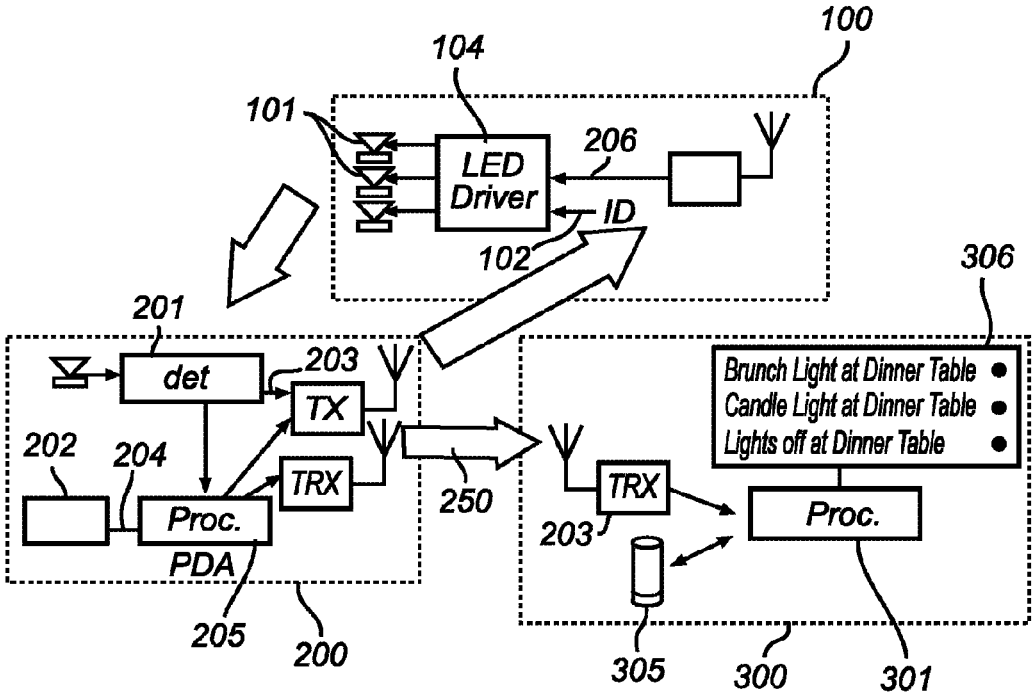
FIG. 3 shows a block diagram of another embodiment of a location commissioning system according to the present invention.

In an alternative embodiment of the location commissioning system, as shown in FIG. 3, the user control unit 200, a PDA, is further arranged to control the lighting arrangements 100 by changing their duty cycles over a ZigBee connection link. Consequently, the user control unit 200 is able to change the amount of light emitted by the lighting arrangements 100 by changing the current drive data 206. The drive data is set by user input or previously retrieved from a main control device 300. Further, the user control unit 200 is provided with processing means 205 for determining light contribution from different lighting arrangements on basis of the identification code 102, which is modulated onto the light emitted by each lighting arrangement 100. The processing means 205 are also used for determining the light transfer data based on the light data 203, which is measured with the detector 201, and the current drive data 206. The light transfer data is then associated to a position id 204, which is entered via the user interface 202. The light transfer data associated to a position id 204 is transmitted to the main control device 300 via a WLAN and is then stored as light effect setting arrays in the data base 305 of the main control device 300. The data transmitted contains:

- the alphanumerical string for naming the position and the light effect setting,
- the identifying codes of the lighting arrangements that are detected (or a subset of these, for instance only the identification codes of the 3 strongest ones), the duty cycles of LEDs to reach the desired light effect setting.

The format of the stored position id, light effect setting, lighting arrangements and duty cycles is f.i.:

<position id, light effect setting>, <ID number of lighting arrangement 1><duty cycle of Red light><duty cycle of Green light><duty cycle of Blue light><duty cycle of Amber light><position id, light effect setting>, <ID number of lighting arrangement 2><duty cycle of Red light><duty cycle of Green light><duty cycle of Blue light><duty cycle of Amber light><ID number of lighting arrangement 3><duty cycle of Red light><duty cycle of Green light><duty cycle of Blue light><duty cycle of Amber light>.

One specific example is:

"Dinner Table, Brunch Light", "PHILIPS 10036745", "0.7", "0.5", "0.8", "0.4", "PHILIPS 20026776", "0.6", "0.5", "0.5", "0.2", "PHILIPS 1008672", "0.6", "0.5", "0.4", "0.3".

The process is repeated for different light settings and different positions in the room and each set is stored as shown in the example above. As another example there can be a setting for "Dinner Table, Candle Light" stored with different duty cycles values. The act of location commissioning is ended with the storage of all relevant or required settings for the room into a database.

The PDA 200 itself can also control the choice of the position and light setting remotely using the data from the main control device 300 via WLAN. For example, during usage, the PDA can ask for a set of specific duty cycles from the database by specifying "position name" and "light effect setting". Thus, the interactive user interface 306 allows user request input regarding required light effects or adjustments of current light effects.

Figure 4:
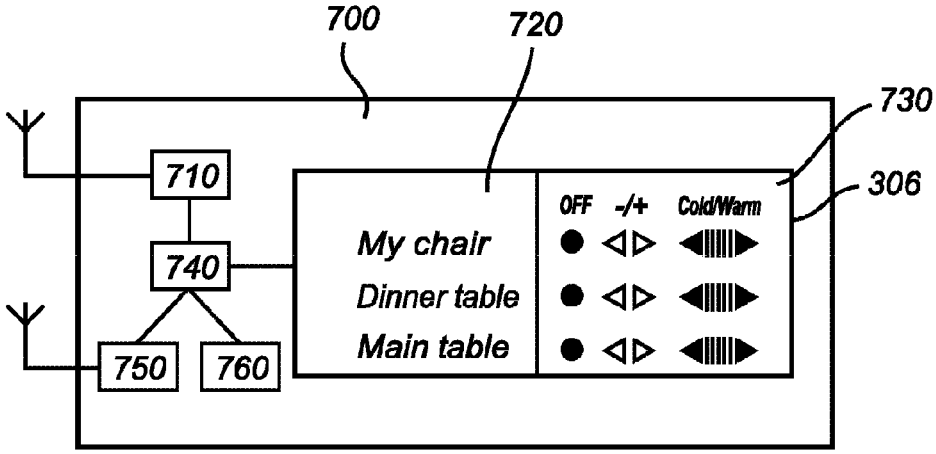
FIG. 4 shows a block diagram of an embodiment of a light effect setting user device according to the present invention.

In another aspect of the present invention there is provided a light effect setting user device 700 for setting the illumination, i.e. light effects, of commissioned locations according to the present invention, as shown in FIG. 4. The light effect user device 700 is preferably realized with a PDA or a remote control, and can in an alternative embodiment preferably be configured within the same PDA-unit as previously described for commissioning purposes, i.e. the user control 200 in FIGS. 1 to 3 or the user control 500 in FIG. 5. The light effect user device is provided with an interactive user interface 306, which is arranged with means for displaying light effect setting data 720, e.g. an LCD-display, and a selection tool 730 for choosing a light effect setting. In FIG. 4 the embodiment shows a selection tool 730 that supports making changes of the light effect settings in locations that are presented in the list presented in the LCD-display 720. The selection tool 730 is arranged with a power button (ON/OFF), buttons for decreasing or increasing the illumination (–/+), and buttons for changing the color content of the light effect for each location. The light effect setting user device 700 is further arranged with means for receiving light setting data: a receiver 710, means for determining drive data according to the chosen light effect setting: processing means 740, means for transferring the drive data to a driving unit of the lighting arrangements: transmitter 750. The device 700 is arranged to present the position id, i.e. the names of the commissioned positions as given by the user during the location commissioning on the LCD-display. Whenever the selection tools 730 associated with one of these names is activated, that position will be illuminated according to the light effect setting that is derived on basis of the transfer data for that position and the request made on the selection tool 730. In FIG. 4 the display shows three positions in the room, which have been previously commissioned: My Chair, Diner Table, and Main Table. The user may turn the light effect on or off, adjust the illumination level (–/+) and the color contents of the light effect (cold/warm) by simply pushing a dedicated arrow key. This way of designing the user interface is merely shown as an example and should not be considered to limit the scope of the invention. As an example, the display may show the names of several previously location commissioned light effects for a certain location like the user interface 306 in FIG. 3. The selection tools 730 may comprise buttons for choosing previously location commissioned light effects, or for changing chromaticity, intensity, hue, saturation or the spot size of the light in a location. Many other combinations are possible and do not fall outside the intent and scope of the present invention.

The user device 700 is further arranged with means for storing light effect setting data 760, from which storage the user device can obtain transfer data for determining drive data to transmit to a driving unit 104 of the lighting arrangements.

In an alternative embodiment the user device is arranged such that it allows a real-time commissioning to take place when the user sets a lighting effect, i.e. the device is preferably integrated with a commissioning user device 200.

In an alternative embodiment the user device 700 is arranged on the main control device.

In yet another alternative embodiment the user device 700 is arranged on the wall.

Figure 5:
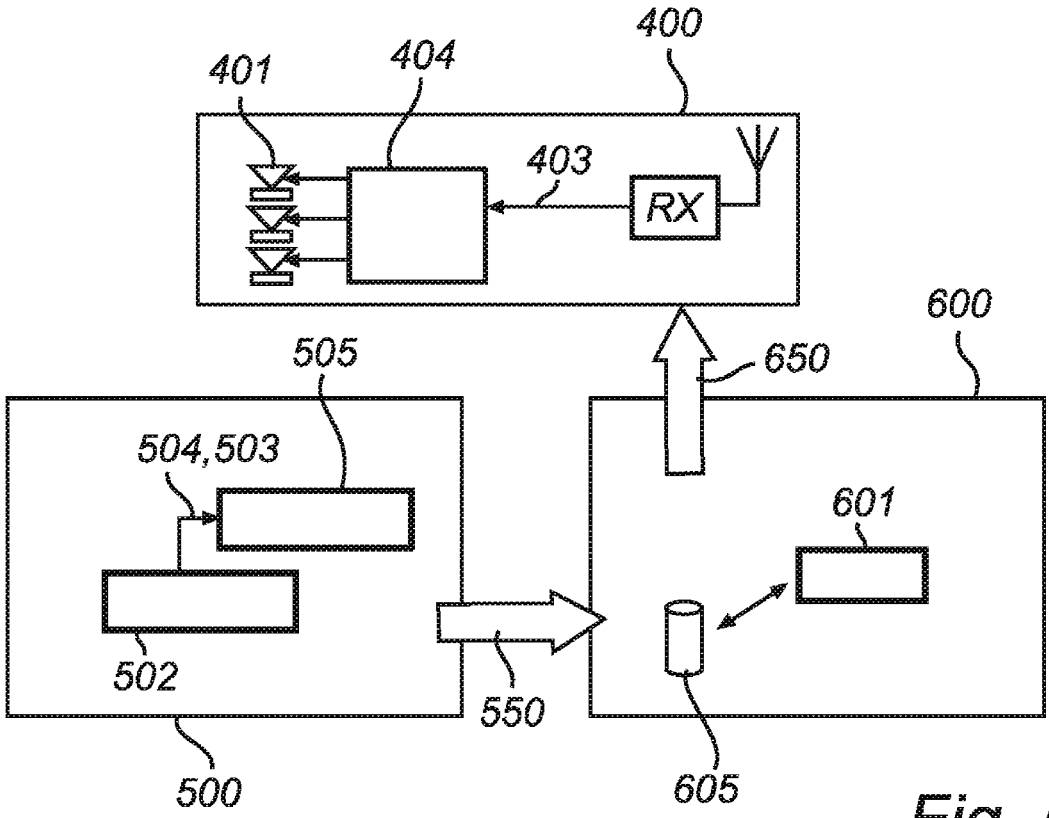
FIG. 5 shows a block diagram of an embodiment of a light effect control system according to the present invention.

An embodiment of a light effect control system according to the present invention, as shown in FIG. 5, consists of several lighting arrangements 400, which are arranged to receive drive data 403 from a main control device 600 via a wireless communication link 650 based on ZigBee, and a user control unit 500, e.g. a PDA, which is provided with means for receiving request data, i.e. a user interface 502 like for instance a keypad or window menu. Via the user interface 502 the user can make one or more requests R for a certain light effect at a certain position in the room, i.e. a target light effect setting. The request, which includes selected target light effect data 503 and the selected position id 504, is transmitted to the main control device 600, via a WLAN 550. The main control device 600 comprises means for fetching a stored associated initial light effect setting array comprising transfer data for the lighting arrangements 400 at the position id 504, i.e. the main control device 600 fetches previously commissioned light effect setting data in the form of light transfer data associated to the position id 504, which in this embodiment is stored in a database 605 in the main control device 600. The main control device 600 is further provided with processing means 601 for determining, by means of the request data and the light transfer data, required drive data 403 for said lighting arrangements, for obtaining the target light effect setting. The main control 600 unit further comprises means for adjusting currently applied drive data 403 to the lighting arrangements 400 in accordance with the required drive data. The main control device 600 performs the processing tasks according to a computer program implementation of a light effect control method in accordance with the present invention.

Figure 6:
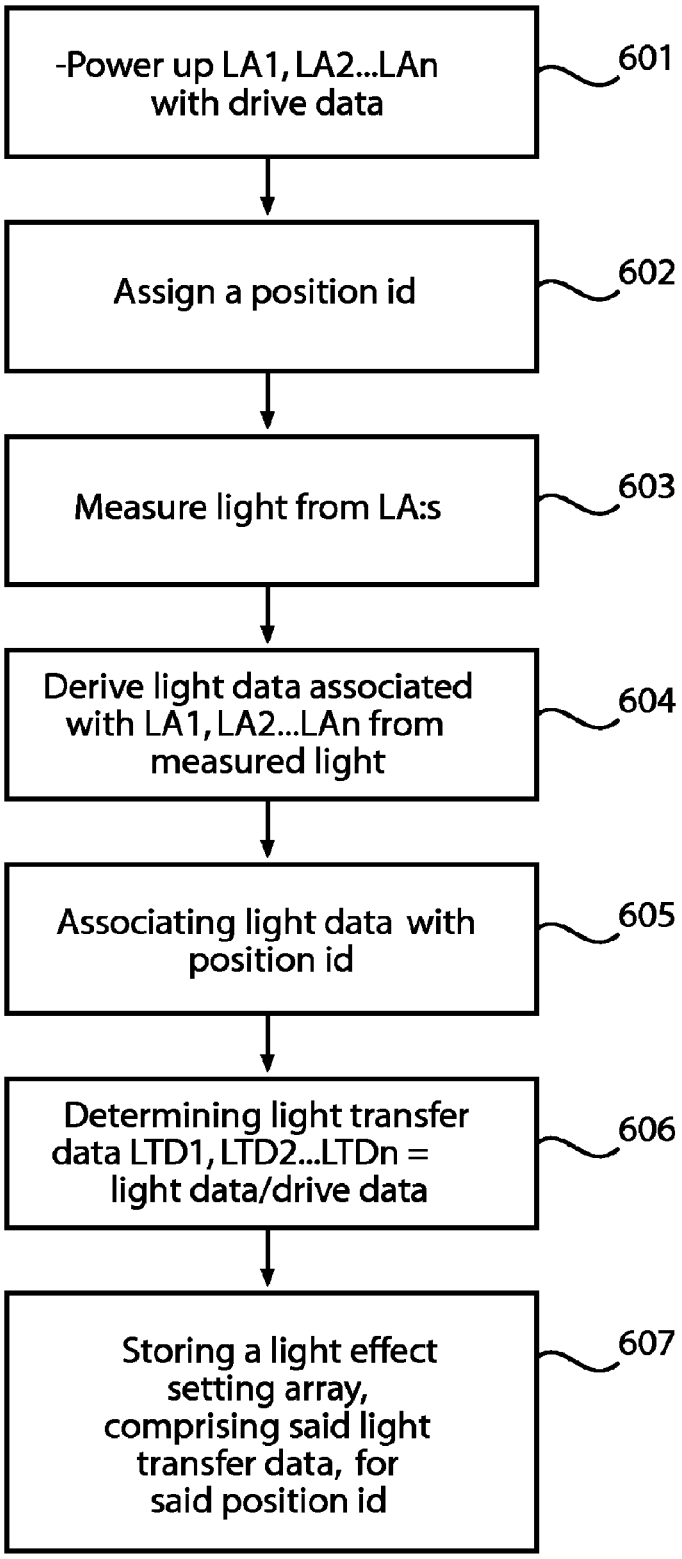
FIG. 6 shows a flow chart for en embodiment of a location commissioning method according to the present invention.
Figure 7:
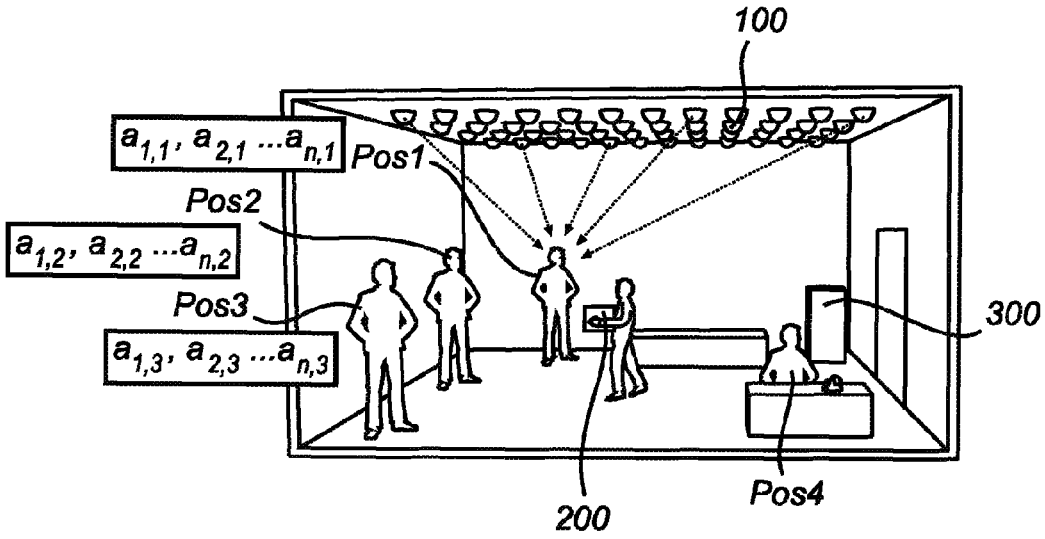
FIG. 7 shows a schematic drawing for an embodiment of a light effect control method in a lighting system according to the present invention.

FIG. 6 shows a flow chart for a location commissioning method according to an embodiment of the present invention. The location commissioning method for a lighting system, which comprises several lighting arrangements, comprises steps as described below with reference to FIGS. 6 and 7.

When a new lighting installation, in a room in a new building, is to be commissioned all the lighting arrangements 100 are first preferably powered (step 601) with the same drive data. A user then decides suitable positions, POS1-POS4, to commission, like for instance working spaces in an office. For each position the user then assigns the position a position id (step 602), e.g. "working space 1", "working space 2". Then the light contribution from each lighting arrangement 100 in the position is measured (step 603), preferably by means of a detector for light coming from all the directions. The detector is preferably connected to a user control unit 200, e.g. a PDA adapted to light location commissioning, such as any one of those user control units described above. The data is then processed, preferably after being transferred from the PDA 200 to a main control device 300, e.g. the computer which controls the lighting arrangements, by deriving light data associated with each one of the lighting arrangements from the measured light (step 604). The light data is associated with the position id (step 605) and, on basis of the light data and current drive data for the lighting arrangements 100, light transfer data is determined (step 606). Thereafter the light transfer data is stored in a light effect setting array for the position id (step 607).

In one embodiment measuring each independent contribution is done by darkroom calibration, i.e. for each position only one lighting arrangement at a time is powered up and measured.

In another embodiment, the lighting arrangements are each provided an identification code, and the step of deriving light data further comprises identifying light data from each one of the lighting arrangements on basis of the identification code.

In different embodiments the light effect setting array further comprises said light data, and/or current drive data, and/or attenuation data. The light data comprises measured light power, and wherein the current drive data comprises transmitted light power. In accordance with an embodiment the storing of the light effect setting array is done in the main control device. In another embodiment the light effect setting array is stored in the user control unit, which is provided with appropriate memory. In that case, the control unit is additionally provided with processing means for determining the light transfer data and retrieving drive data.

In an alternative embodiment of the location commissioning method, another type of location commissioning is done according to the following description. Instead of applying the same drive data to the lighting arrangements the user, who in this case might be a light designer with the skills of creating light effects, creates light effects in a position, providing them with names, e.g. "working light", "evening light" and so on. The location commissioning system then stores light effect setting vectors associated to a certain light effect. The unskilled end user of the lighting system can then later use the commissioned light effect setting to reproduce "working light"-settings or "evening light"-settings.

When using the commissioned light effect setting vectors in every day use, a light effect setting method for controlling lighting arrangements of a lighting system according to the present invention is used. The method can be used when a user makes at least one request R, which request comprises a selected light effect at a selected position.

In an embodiment of the light effect setting method according to the present invention the features of the light effect that can be set are:

chromaticity and intensity (using an XYZ-description or equivalent), size, and spot of the light Location/Requirement Priority The location/requirement priority is valid in the case of multiple requests. The request is done on a user control unit 500 of the lighting system which incorporates a user interface 502. Different user interfaces can be used to realize this, e.g. a (x,y) chromaticity map together with a tool for defining a target intensity, or an arrow keys. Other functionalities are present in the user control unit 500 to define other features like size of the spot of light and the priority for a certain request. Setting the priority of a certain request becomes necessary whenever the user intends to generate different light effects in neighboring locations. In that case, the same lighting arrangements 400 contribute to different light effects and the priority setting allows the present method to decide what contribution any lighting arrangement 400 should give to a certain light effect. The target location for the light effect is chosen by simply choosing a previously commissioned position.

The method is performed preferably by a computer program, which runs in the main control device 600, controlling the lighting arrangements (or in the user control unit if it is provided with appropriate computational power and means for controlling the lighting arrangements) in the steps of:

receiving the request data comprising a position id and a target light effect setting associated with the position from the user control unit;

fetching a stored associated initial light effect setting array comprising light transfer data for said lighting arrangements at the position;

determining, by means of the light transfer data, required drive data for the lighting arrangement, for obtaining the target light effect setting; and adjusting currently applied drive data of the lighting arrangements in accordance with the required drive data.

The light transfer data comprises attenuation data, and the step of determining required drive data further comprises the steps of:

deriving a vector of attenuation parameters for lighting arrangements 1 to n for position j from said initial light effect setting array according to: $a_j=[a_{1j}, a_{2j}, \ldots, a_{nj}]$;

deriving a required radiant power $U_j$ for light in position j from said target light effect setting; and calculating a transmitted radiant power $T_{i,j}$ for each lighting arrangement i based on $U_j$ for light in position j.

It should be noted that the parameter of the amount of radiant power $U_j$, which is obtained form the luminous flux, after correcting for the human perception, and which should be delivered for each primary in the target position in order to render the requested light effect, is preferably constituted by a vector for all primaries, e.g. RGB which gives $[U_R, U_G, U_B]$. Each primary is processed independently, and for simplicity in Eq. 1 below we indicate by U the required radiant power for an arbitrary primary and by l the number of installed lighting arrangements for that primary.

The step of calculating a transmitted radiant power $T_{i,j}$ for each lighting arrangement i of a primary for a position j is done according to:

$$T_{i,j} = \frac{1}{a_{i,j}} U_j \frac{a_{i,j}}{\sum_{m=1}^{l} a_{m,j}} \text{ for } i \in \{1, \ldots, l\} \quad \text{Eq. 1}$$

wherein l is the total number of lighting arrangements, and $U_j$ is the required radiant power for a position j.

Let us consider a lighting system according to the present invention comprising a plurality of lighting arrangements that comprises RED, GREEN and BLUE sources, which are available on the ceiling. A user in a certain position j makes a light effect request for 'yellow light'. In order to determine the required radiant powers of red, green and blue necessary to render yellow light for a position j, as a first operation the system will map the yellow color point in the RGB color space. This operation will tell the system what is the required amount of red radiant flux $U_R$, green radiant flux $U_G$, and blue radiant flux $U_B$. In this simple case, evidently, $U_B=0$ while $U_R$ and $U_G$ will be more or less equal (mixing red and green we get yellow). The exact values of $U_R$ and $U_G$ will depend on the requested intensity. Secondly, once this information is available, the system will determine the contribution of red light, i.e. transmitted radiant power from each available red lamp by means of Eq. 1 and using $U_R$. Then, by means of the same equation and using $U_G$, the system will determine the contribution from each available green lamp. In the case of blue, Eq. 1 would give zero as a result for all the blue lamps since the required blue light at the target location is null. This is the procedure that the system follows.

In a similar case, starting from a lighting system that comprises RED, GREEN, BLUE, AMBER, a mapping similar to the one described above would lead to $U_R$, $U_G$, $U_B$, $U_A$. Then, by applying four times the Eq. 1 the required transmitted radiant powers that should come from red, green, blue, amber lamps will be determined.

In summary, given a system that incorporates lighting arrangements with p primary colors, for instance two or more of red, green, blue, amber, cyan, magenta . . . , for a position j the system would first map the required color point into this p-dimensional color space, thus determining $U_{k,j}$ for $k \in \{1, \ldots, p\}$. Each $U_{k,j}$ would be the input for the Eq. 1 and for each light arrangement we can calculate the transmitted radiant power $T_{i,j}$ as $T_{i^{(k)},j}$ according to:

$$T_{i^{(k)},j} = \frac{1}{a_{i^{(k)},j}} U_{k,j} \frac{a_{i^{(k)},j}}{\sum_{m=1}^{l_k} a_{m,j}} \text{ for } i^{(k)} \in \{1, \ldots, l_k\} \text{ and } k \in \{1, \ldots, p\}, \quad \text{Eq. 2}$$

wherein $l_k$ is the total number of lighting arrangements for a primary k, $U_{k,j}$ is the required radiant power of $a_{i^{(k)},j}$ primary k for a position j, $i^{(k)}$ is a lighting arrangement of primary color k, and $a_{i^{(k)},j}$ is the power attenuation from lighting arrangement $i^{(k)}$ to location j. Preferably, the input data further comprises a size of a spot of light $\gamma_j$ for said lighting arrangements in said position. The step of calculating a transmitted radiant power $T_{i^{(k)},j}$ of each lighting arrangement $i^{(k)}$ in each primary color k for a position j is done according to:

$$T_{i^{(k)},j} = \frac{1}{a_{i^{(k)},j}} U_{k,j} \frac{a_{i^{(k)},j}^{\gamma_j}}{\sum_{m=1}^{l_k} a_{m,j}^{\gamma_j}} \text{ for } i^{(k)} \in \{1, \ldots, l_k\} \text{ and } k \in \{1, \ldots, p\} \quad \text{Eq. 3}$$

wherein $l_k$ is the total number of lighting arrangements in primary color k, $U_{k,j}$ is the required radiant power for primary color k at a position j, $a_{i^{(k)},j}$ is the power attenuation from lighting arrangement $i^{(k)}$ to location j, and $\gamma_j \in [1,\text{inf})$, and wherein for $\gamma_j=1$, all the lighting arrangements contribute equally to the target light effect, and when $\gamma_j$ tends to infinity, only the closest lighting arrangement is powered.

Given $R \in \{1, \ldots, \text{inf}\}$ requests, for a number of user request R>1 the method further comprises the steps of:

calculating a resulting transmitted power $\overline{T_{i^{(k)}}}$, as a weighted average of the transmitted radiant power $T_{i^{(k)},j}$ of lighting arrangement $i^{(k)}$ of primary color k for the position j, by means of least square fitting.

The resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j}}{\sum_{m=1}^{R} a_{i^{(k)},m}} \text{ for } i^{(k)} \in \{1, \ldots, l_k\} \text{ and } k \in \{1, \ldots, p\} \quad \text{Eq. 4}$$

wherein $l_k$ is the total number of lighting arrangements for primary color k, $T_{i^{(k)},j}$ is the transmitted radiant power of lighting arrangement $i^{(k)}$ of primary color k to the position j, $a_{i^{(k)},j}$ is the power attenuation from lighting arrangement $i^{(k)}$ to location j, and $R \in \{1, \ldots, \text{inf}\}$ is the total number of user requests.

When the correct transmitted powers $\overline{T_{i^{(k)}}}$ for all the lighting arrangements are determined it is preferred that a smooth temporal convergence from the starting light effect setting to said target light effect setting is achieved. This is guaranteed by the further steps of:

defining the difference in transmitted radiant power for said starting light effect setting to said target light effect setting;

defining intermediate steps of transmitted radiant powers; and changing the light effect setting by said intermediate steps until the target light effect setting is obtained.

The intermediate steps have a maximum step size, which is preferably related to human perception.

Local and Global Priorities

As many requests and users are allowed for a system, and the lighting arrangements may not be considered independent from each other the concept of priorities is introduced to the inventive concept. The priorities may be local or global.

As an example of local rights lighting effects can be given different priorities in different locations, as will be described hereinafter:

Each one of the light effects is provided with a particular local priority ρ for a position j, whereby a light effect with a higher priority will have a larger contribution to the achieved target settings in a position than a light effect with a lower priority.

The resulting transmitted power $\overline{T_{i^{(k)}}}$ of lighting arrangement $i^{(k)}$ of primary color k for R requests is then calculated according to:

$$\overline{T_{i^{(k)}}} = \sum_{j=1}^{R} T_{i^{(k)},j} \frac{a_{i^{(k)},j}^{\rho_j}}{\sum_{m=1}^{R} a_{i^{(k)},m}^{\rho_j}} \text{ for } i^{(k)} \in \{1, \ldots, l_k\} \text{ and } k \in \{1, \ldots, p\} \quad \text{Eq. 5}$$

wherein $l_k$ is the total number of lighting arrangements for primary color k, $T_{i^{(k)},j}$ is the transmitted radiant power of lighting arrangement $i^{(k)}$ of primary color k to the position j, $a_{i^{(k)},j}$ is the power attenuation from lighting arrangement $i^{(k)}$ to location j, $R \in \{1, \ldots, \inf\}$ is the total number of user requests, and $\rho_j \in [1, \inf)$, indicates the priority of a light effect in the position j.

As an example of global rights, Scenario 1 and 2 which will follow describes user rights. Global rights may however include other specific rights like for instance a global right for lighting all lighting arrangements if there is a fire alarm, or any other alarm, which will be given the highest priority in the lighting system.

Figure 8:
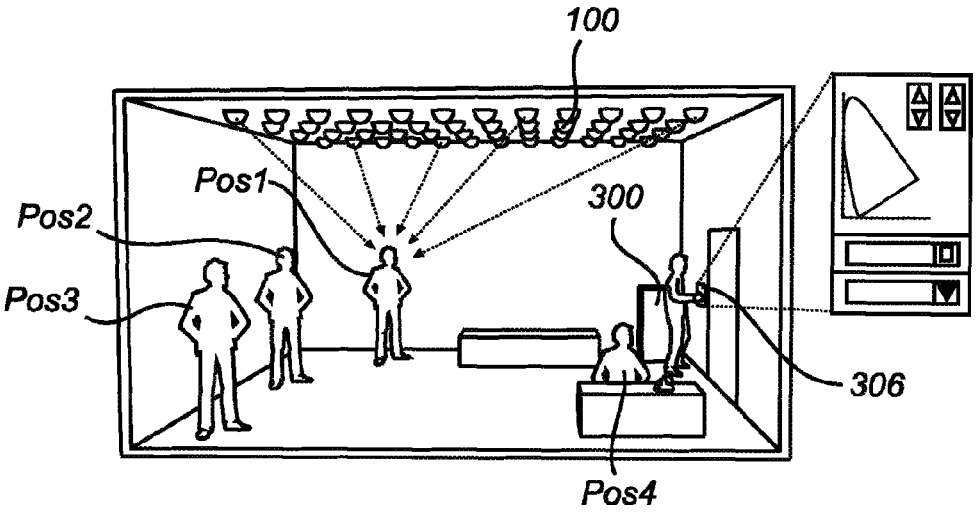
FIG. 8 shows a schematic drawing for an embodiment of a light effect control method in a lighting system according to the present invention.

It should be noticed that the method is able to generate light effects, and adding them to other light effects already in action. For instance a user can set a certain light effect in a certain position, POS1 in FIG. 8, and observe the resulting light effect. The features of this light effect can be modified, via the user interface 306, until the user is satisfied with the outcome. Then the user can request another light effect at a different position, POS2 in FIG. 8. The method will render the two light effects choosing the optimum solution for the transmitted radiant powers. This operation can continue until the complete set of light effects is generated. At this point the lighting conditions remain unchanged until the user decides to add one or more light effects or to remove one or more light effects that have been previously generated.

The light effect setting method as described above allows a generic user to create arbitrary light effects but it does not make any distinction based on the identity of the user setting the light. Thus, all the requests coming to the system are processed and elaborated in the same way without taking into account whether the user is authorized or not for a certain operation. This means that an unauthorized user who accidentally has access to the user control unit can modify the light conditions and disturb the integrity of the light effect settings. This can also lead to inconvenience when two users make conflicting requests and one of them has a larger authority in light effect settings. According to an embodiment of the light effect setting method user rights restrictions are employed for controlling the light effect settings. The user rights are assigned to authorized users by the system administrator during a initialization phase. Then, the user rights are collected in a look-up table that is stored in a memory. Each user is identified with a user ID and corresponds to a row or column in the look-up table. Depending on the scenario, the user rights for each user come in the form of a vector of one or more elements.

In order to further exemplify the use of user rights two different scenarios will be described below.

Scenario 1

In this scenario, a user generates light effects by means of a user interface device. In this case, the system administrator assigns each user a user right which is valid in the whole environment. In particular, $w_q \in [0,1]$ indicates the right of user q to generate a light effect in any position of the environment. A value $w_q=1$ indicates that user q has the full right to change the light settings and all his/her requests will be assessed by the system in accordance with the level of priority. A value $w_q$ smaller than 1 but larger than 0 indicates that the user does not have full rights and that, in case of conflicting requests, his/her requests will be satisfied according to the request priority (requests with higher priority will have higher precedence over those with lower priority). Finally, a value $w_q=0$ indicates that any request of the user will not generate any effect in the light atmosphere. Notice that unauthorized users have a null user right by default.

The user rights can also be a function of the time $w_q(t)$. In this way, it is possible to put time constraints on the operations or more generally to vary the permission granted to a user during the day.

Furthermore, the user rights can depend on the light sources present in the setup $w_{q,1}$. This can give the administrator the freedom to assign different weights to different light sources. An example would be a shop owner giving rights to change the lighting atmosphere in a location of the shop to the visitors. Similar to this, in the second scenario different weights can be given to special positions. Having weights dependent on the light source gives a way of fine control without defining special locations or points of interest.

Scenario 2

In this scenario, a user generates light effects addressed to a certain target position by means of a control panel in the wall. The target locations have been identified and stored in the system during the location commissioning phase. In this case, the system administrator assigns each user a collection of user rights, each one valid in a different target position. In particular, $w_{q,j} \in [0,1]$ indicates the right of user q to generate a light effect in a position j. Depending on the value of $w_{q,j}$ the user q has full, partial or no rights in position j and his/her requests are processed accordingly in a similar way as in Scenario 1.

The user rights can also be a function of the time $w_{q,j}(t)$. In this way, it is possible to put time constraints on the operations or more generally to vary the permission granted to a user during the day.

The resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j} \cdot z_j}{\sum_{m=1}^{R} a_{i^{(k)},m} \cdot z_m} \text{ for } i^{(k)} \in \{1, \ldots, l_k\} \text{ and } k \in \{1, \ldots, p\} \quad \text{Eq. 6}$$

wherein $a_{i^{(k)},j}$ is the power attenuation from lighting arrangement $i^{(k)}$ to location j, and $z_j$ is a mapping of said user rights ($w_q$ or $w_{q,j}$ or $w_{q,j}(t)$).

The extension to Eq. 5 to assess the user rights in the determination of the light outputs of the lighting arrangements will be described hereinafter. The total number of requests of light effects coming from any user is indicated by R. Moreover by $T_{i^{(k)},j}$ is indicated the power that is to be transmitted by lighting arrangement $i^{(k)}$ primary color k to satisfy a certain request j and by $z_j$ the user right corresponding to the user that generated this request. Notice that any time a user identifies himself with his user ID, the system retrieves the information about his personal user rights ($w_q$ or $w_{q,j}$) and map it on the local parameter $z_j$.

Then, the transmitted radiant power from lighting arangement $i^{(k)}$, when R requirements (with the corresponding user rights) are to be satisfied is:

$$\overline{T_{i^{(k)}}} = \sum_{j=1}^{R} T_{i^{(k)},j} \frac{a_{i^{(k)},j}^{\rho_j} \cdot z_j}{\sum_{m=1}^{R} a_{i^{(k)},m}^{\rho_m} \cdot z_m} \text{ for } i^{(k)} \in \{1, \ldots, l_k\} \text{ and } k \in \{1, \ldots, p\} \quad \text{Eq. 7}$$

Wherein $\rho_j \in [1,\text{inf})$ indicates said local priority of the request j, $a_{i^{(k)},j}$ is the power attenuation from lighting arrangement $i^{(k)}$ to location j, and $z_j$ is a mapping of said user rights ($w_q$ or $w_{q,j}$ or $w_{q,j}(t)$).

The result determined by Eq. 7 is a weighted average among the different requests that takes into account two types of prioritization. On the one hand, each user can set local priorities among the requests that he/she enters and this is reflected in the variable $\rho_j$. On the other hand, there is a prioritization based on the user right $z_j$ that corresponds to any request that is generated. This second type of prioritization favors requests coming with higher user rights over requests with lower ones. Eventually, Eq. 7 privileges those requests with a large $a_{i,j}^{\rho_j} \cdot z_j$.

Above, embodiments of the methods and systems according to the present invention as defined in the appended claims have been described. These should be seen as merely non-limiting examples. As understood by a skilled person, many modifications and alternative embodiments are possible within the scope of the invention.

Thus, the present invention provides methods and devices for, on the one hand, location commissioning, i.e. Luxissioning™, and, on the other hand, controlling a lighting system having plural lighting arrangements. The location commissioning and controlling are closely related to each other, while at the same time representing two separate modes or phases. By means of the location commissioning transfer data for each individual lighting arrangement is obtained and stored. That transfer data is useful later on when a user wants to change the light effect or recover a particular, previously defined, light effect at a particular position, which is reached by light originating from at least one of the light arrangements.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A light effect setting method for controlling lighting arrangements of a lighting system, which comprises several lighting arrangements, according to at least one request R, which requests a selected light effect at a selected position, comprising, for each request, receiving request data comprising a position identification code and a target light effect setting associated with the position corresponding to the identification code;

obtaining an associated initial light effect setting array comprising light transfer data for said lighting arrangements at said position;

determining, by means of said light transfer data, required drive data for said lighting arrangements, to obtain said target light effect setting; and adjusting currently applied drive data of said lighting arrangements in accordance with said required drive data.

2. A light effect setting method according to claim 1, wherein said light transfer data comprises attenuation data, and wherein the step of determining required drive data further comprises the steps of:

deriving a vector of attenuation parameters for lighting arrangements 1 to n in the position j from said initial light effect setting array according to: $a_j=[a_{1,j}, a_{2,j}, \ldots, a_{n,j}]$ deriving a required radiant power $U_j$ for light in position j from said target light effect setting;

calculating a transmitted radiant power $T_{i,j}$ for each lighting arrangement i based on $U_j$ and $a_j$ for light in position j.

3. A light effect setting method according to claim 2, wherein said lighting arrangements emit different primary colors, where the number of primary colors is p, and where the number of lighting arrangements of each primary color is $I_k$, wherein said required radiant power $U_j$ for light in position j equals the sum of the radiant powers of said p primary colors according to:

$$U_j = U_{1,j} + U_{2,j} + \ldots + U_{p,j} = \sum_{k=1}^{p} U_{k,j},$$

wherein the required radiant powers $U_{1,j}, U_{2,j}, \ldots, U_{p,j}$ for each primary color are determined by performing the steps of:

mapping the color point of said target light effect in a p-dimensional primary color space; and extracting from the color space the required amount of radiant power $U_{1,j}, U_{2,j}, \ldots, U_{p,j}$ for each primary color;

and wherein the step of calculating transmitted radiant power is done for each primary color, where $T_{i,j}=T_{i^{(k)},j}$ for $i^{(k)} \in \{1, \ldots, l_k\}$ and $k \in \{1, \ldots, p\}$.

4. A light effect setting method according to claim 2, wherein the step of calculating a transmitted radiant power $T_{i,j}$ for each lighting arrangement i for a position j is done according to:

$$T_{i,j} = \frac{1}{a_{i,j}} U_j \frac{a_{i,j}}{\sum_{m=1}^{n} a_{m,j}} \text{ for } i \in \{1, \ldots n\},$$

wherein $a_{i,j}$ is the power attenuation from lighting arrangement i to location j, $U_j$ is the required radiant power for light in position j and n is the total number of lighting arrangements.

5. A light effect setting method according to claim 3, wherein the step of calculating a transmitted radiant power $T_{i^{(k)},j}$ for each lighting arrangement $i^{(k)}$ in each primary color k for a position j is done according to:

$$T_{i^{(k)},j} = \frac{1}{a_{i^{(k)},j}} U_{k,j} \frac{a_{i^{(k)},j}}{\sum_{m=1}^{l_k} a_{m,j}} \text{ for } i^{(k)} \in \{1, \ldots, l_k\} \text{ and } k \in \{1, \ldots, p\},$$

wherein $l_k$ is the total number of lighting arrangements in primary color k, $U_{k,j}$ is the required radiant power for light of primary color k at a position j, $a_{i^{(k)},j}$ is the power attenuation from lighting arrangement $i^{(k)}$ to location j.

6. A light effect setting method according to claim 1, further comprising the steps of, for a number of user requests R>1:

calculating a resulting transmitted power $\overline{T_{i^{(k)}}}$, as a weighted average of the transmitted radiant power $T_{i^{(k)},j}$ of each lighting arrangement $i^{(k)}$ of primary color k for the position j, by means of least square fitting.

7. A light effect setting method according to claim 6, wherein the resulting transmitted power $\overline{T_{i^{(k)}}}$ of lighting arrangement $i^{(k)}$ of primary color k for R requests is calculated according to:

$$\overline{T_{i^{(k)}}} = \sum_{j=1}^{R} T_{i^{(k)},j} \frac{a_{i^{(k)},j}}{\sum_{m=1}^{R} a_{i^{(k)},m}} \quad \text{for } i^{(k)} \in \{1, \ldots, l_k\} \text{ and } k \in \{1, \ldots, p\}$$

wherein $l_k$ is the total number of lighting arrangements for primary color k, $T_{i^{(k)},j}$ is the transmitted radiant power of lighting arrangement $i^{(k)}$ of primary color k to the position j, $a_{i^{(k)},j}$ is the power attenuation from lighting arrangement $i^{(k)}$ to location j, and $R \in \{1, \ldots, \inf\}$ is total number of user requests.

8. A light effect setting method according to claim 1, further comprising smoothly converging from a starting light effect setting to said target light effect setting by defining the difference in transmitted radiant power for said starting light effect setting to said target light effect setting;

defining intermediate steps of transmitted radiant powers;

changing the light effect setting by said intermediate steps in drive data until the target light effect setting is obtained.

9. A light effect setting method according to claim 1, wherein said at least one user request R is restricted to a particular user control right that is provided by an access control mechanism based on public-key cryptography or symmetric-key cryptography.

10. A light effect control system comprising:

several lighting arrangements, means for driving the light output of the lighting arrangements by lighting drive data, a user control device comprising means for retrieving at least one set of request data, which request data comprises a selected target light effect setting at a selected position id, and means for transmitting said at least one set of request data, a main control device comprising means for receiving request data from said user control device, and means for transmitting drive data to said lighting arrangements, characterized in that:

said main control device further comprises means for obtaining an associated initial light effect setting array comprising light transfer data for said lighting arrangements at said position id, means for determining, by means of said light transfer data, required drive data for said lighting arrangements, means for obtaining said target light effect setting, and means for adjusting currently applied drive data of said lighting arrangements in accordance with said required drive data.

11. A light effect control system according to claim 10, wherein said means for obtaining an associated initial light effect setting array are arranged to retrieve said associated initial light effect setting array from a storage medium.

* * * * *